US006146018A

United States Patent [19]

Keller et al.

[11] Patent Number: 6,146,018

[45] **Date of Patent: *Nov. 14, 2000**

[54] GIFT PACKAGE

[75] Inventors: Janet T. Keller, Eagan; Perry S. Dotterman, Maplewood; Karen F. MacDonald, St. Paul, all of Minn.

[73] Assignee: 3M Innovative Properties Company, St. Paul, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/105,370

[22] Filed: Jun. 26, 1998

[51] Int. Cl.[7] ..... B65D 33/16

[52] U.S. Cl. ..... 383/78; 383/80; 383/93; 229/125.32; 229/923

[58] Field of Search ..... 383/33, 78, 79, 383/80, 81, 82, 93, 95; 220/495.08; 229/125.31, 128.32, 87.18, 87.19, 922, 923

[56] References Cited

U.S. PATENT DOCUMENTS

| | | | |
|---|---|---|---|
| D. 305,728 | 1/1990 | Tufariello . | |
| 1,612,166 | 12/1926 | Baldwin | 229/125.32 X |
| 2,028,714 | 1/1936 | Burwick | 383/78 X |
| 2,080,453 | 5/1937 | Kraut | 383/81 X |
| 2,244,282 | 6/1941 | Bergstein | 383/78 X |
| 3,006,532 | 10/1961 | Fine . | |
| 3,064,876 | 11/1962 | Warner | 229/87.19 X |
| 3,268,151 | 8/1966 | Soto . | |
| 4,379,519 | 4/1983 | Sherwood | 383/33 |
| 4,417,609 | 11/1983 | Sherwood | 383/33 X |
| 4,657,176 | 4/1987 | Matsubara | 229/125.32 |
| 4,836,690 | 6/1989 | Cheng . | |
| 4,867,577 | 9/1989 | Cheng . | |
| 4,892,224 | 1/1990 | Graham | 220/495.08 X |
| 4,930,903 | 6/1990 | Mahoney . | |
| 5,044,773 | 9/1991 | Harms et al. . | |
| 5,165,800 | 11/1992 | Downey . | |
| 5,441,348 | 8/1995 | Valentino . | |
| 5,608,949 | 3/1997 | Cooley et al. . | |
| 5,671,861 | 9/1997 | Hall et al. | 220/495.08 |
| 6,000,849 | 12/1999 | Keller et al. | 383/78 X |

FOREIGN PATENT DOCUMENTS

| | | | |
|---|---|---|---|
| 820 | 7/1931 | Australia | 383/90 |

*Primary Examiner*—Jes F. Pascua
*Attorney, Agent, or Firm*—Michaele A. Hakamaki

[57] ABSTRACT

A gift package that comprises a bag having generally parallel front and rear walls, each having a top edge, a bottom edge opposite the top edge, and two lateral edges, a pair of generally parallel side walls, each having a top edge, a bottom edge opposite the top edge, and two lateral edges, wherein the lateral edges of the front and rear walls are joined to the lateral edges of the side panels, and a bottom panel having two pairs of generally parallel lateral edges, wherein the lateral edges of the bottom panel are joined to the bottom edges of the front, rear, and side walls to form a container having an opening defined by the top edges of the front, rear, and side walls. The gift package further includes a bag topper comprising a body portion and at least one fastening means projecting from the body portion, wherein the at least one fastening means engages with the top edge of at least one of the front, rear, or side walls of the bag to support the bag topper on the top edge of the wall. The side walls of the gift package may further comprise at least one generally central longitudinal fold and at least two diagonal folds extending therefrom.

6 Claims, 4 Drawing Sheets

GIFT PACKAGE

TECHNICAL FIELD

The present invention relates to bag closures, in particular to a reusable bag closure adapted to conceal the contents of the bag.

BACKGROUND OF THE INVENTION

In recent years, there has been a tremendous growth in the manufacture and sale of containers, particularly decorative containers for receiving and holding objects, such as gift objects. One form of such containers is a decorative bag that is adapted to receive a gift item, which eliminates the need to place the items in separate boxes that are usually subsequently wrapped with gift wrapping paper. Instead, gift items may be "wrapped" in the bag and hidden from view using such items as tissue paper, confetti, bag stuffing, shredded ribbons, and the like. However, it is difficult to securely close such decorative bags if the user wishes to completely enclose the item in the bag. Several examples of bag closing methods include using decorative twist ties, tying bag handles together (if the bag has such handles), placing a fastenable bag closure on the bag (see, for example, U.S. Pat. Nos. 5,608,949 and 5,165,800), attaching a bow mechanism, such as that shown in U.S. Pat. No. 4,867,577, and stapling or taping the bag closed.

While these closures are useful, they often disadvantageously reduce the amount of usable space within the gift bag. One suggested solution to this problem was to provide inner structural support to give the bag the appearance of a box, and to provide a rectilinear lid to close the mouth of the bag. The handles of this bag extend through the slots in the lid, such as is shown in U.S. Pat. No. 4,930,903. Another alternative means for converting a gift bag into a "gift box" is to provide for overlapping flaps that can be folded into a configuration that gives a box-like appearance, such as that shown in U.S. Pat. No. 4,836,690.

SUMMARY OF THE INVENTION

In one aspect of this invention a gift package is provided comprising a bag having generally parallel front and rear walls and two generally parallel side walls, wherein each wall has generally parallel top and bottom edges and two lateral edges, and a bag topper comprising a body portion and at least one fastening means that fastens and closes the bag. The bag may further comprise at least one central longitudinal crease or fold in each of the two side panels and at least two diagonal creases or folds at the bottom edges of the two side panels. In this case, the bag topper fastening means may utilize the creased top edge of the side panel for fastening thereto.

Optionally, the bag topper can be decorated with various configurations of gift ribbons, cut-out figures, balloons, and other decorative items. These items can be used to "address" the gift bag to the recipient, provide a greeting, identify the occasion for the gift bag, provide for visually stimulating decorations, and the like. Advantageously, the gift bags, particularly the closing mechanism provided by this invention, allow the user to utilize the full interior of the bag while being able to securely close the bag. Additionally, the closing mechanism may be decorative.

The preformed gift bag topper of the present invention is convenient, simple to use, and minimizes the time required to decorate a gift bag. Furthermore, the preformed gift bag topper eliminates the potential frustration of forming tissue or other fillers into a pleasing decorative shape. The present invention allows all users, whether creatively inclined or not, to quickly and attractively "wrap" a gift. Additionally, the article of the present invention is configured in such a manner so that it may easily incorporate a wide variety of decorations.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Figure 1:
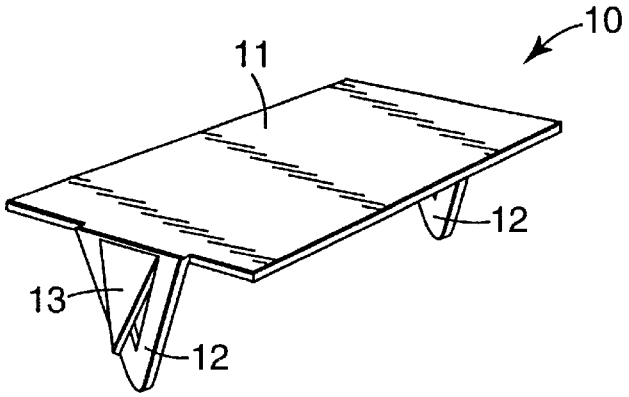
FIG. 1 is an isometric view of a closing mechanism of the present invention.
Figure 2:
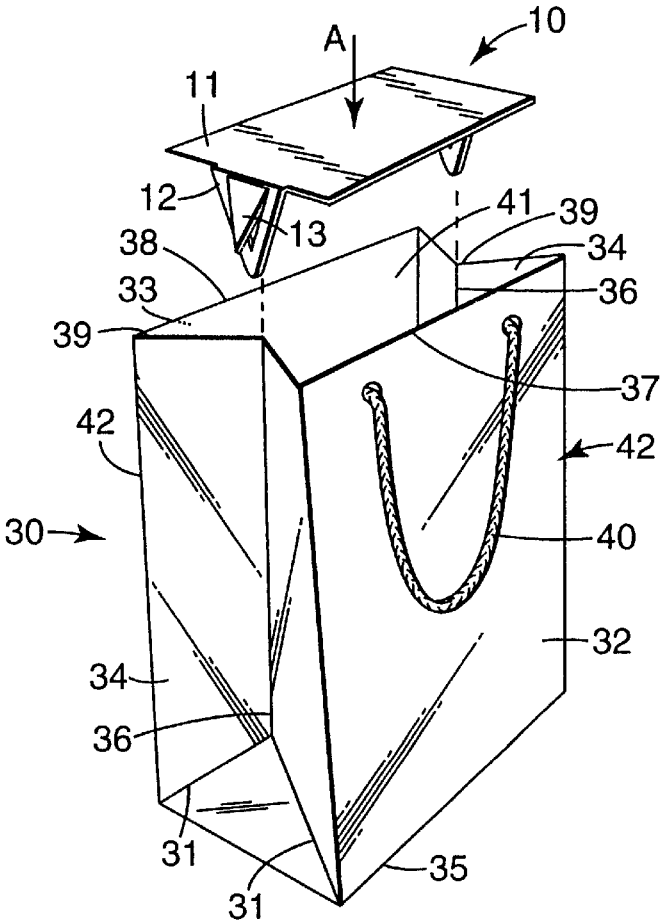
FIG. 2 is an isometric view of a gift bag and the closing mechanism of FIG. 1.
Figure 3:
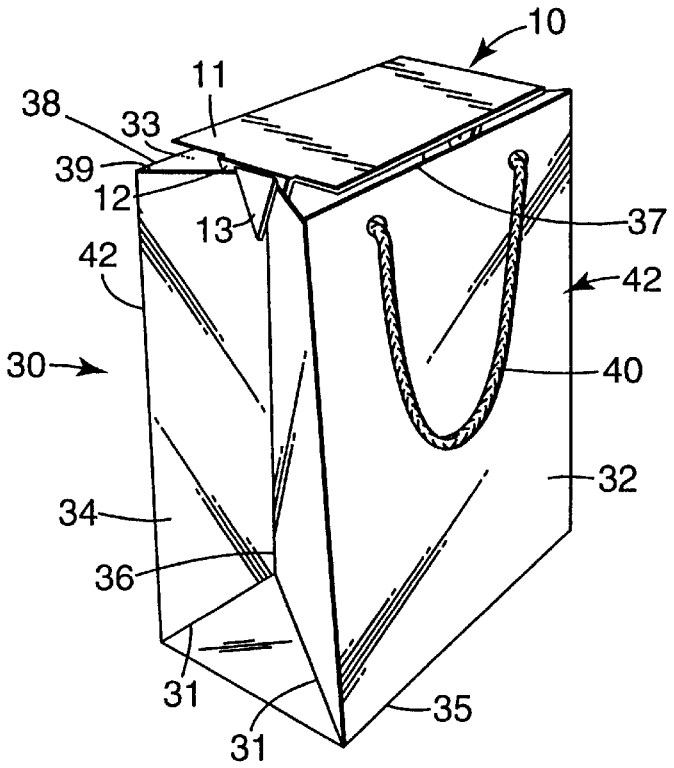
FIG. 3 is an isometric view of the gift bag and closing mechanism of FIG. 2, wherein the bag is closed.

Referring now to the Figures, wherein the components are labeled with like numerals throughout the several Figures, and initially to FIGS. 1, 2, and 3, one preferred embodiment of the gift package of the present invention is shown, generally comprising a bag 30 and a bag topper 10. The bag 30 is preferably fabricated from decorated paper, cardstock, or polymeric film, any of which may be coated or uncoated. The material is generally flexible, but possesses a degree of stiffness that is sufficient to provide a free-standing, upright bag. The bag 30 is conventional in design, including four longitudinal folds 42 dividing the bag 30 into generally parallel front and back walls or panels 32, 33 and two generally parallel side walls or panels 34. The parallel front and back panels 32, 33 each have an upper edge 37, 38, respectively. The bottom of the bag is folded in such a way as to provide for a flat bottom 35, which is preferably rectilinear in shape. The bag 30 as illustrated is in an open position providing an opening 41, through which access is gained to the interior of the bag 30. The parallel side panels 34 have central longitudinal creases or folds 36 and a pair of diagonal folds 31 extending from the crease or fold 36. The side panels also have upper edges 39, which extend between the upper edges 37, 38 of the front and back panels 32, 33. Further, the upper edges 37, 38, 39 of the bag are generally fabricated so that the edges 37, 38, 39 have a double material thickness.

The bag 30 is preferably further provided with a pair of handles 40, where one handle is connected to front panel 32 and the other handle 40 is connected to the back panel 33. The handles 40 may be of any suitable type and as illustrated may be a relatively flexible material, such as a ribbon, cording, or the like. The handles 40 may be attached and secured to the bag in any suitable fashion. Although the handles 40 are illustrated as lying on the outside surface of the front panel 32, the handles 40 may also be attached and secured to the front and back panels 32, 33 in such a manner as to allow the handles 40 to lie on the surface of the front and back panels 32, 33 on the inside of the bag 30. Alternatively, the handles may be relatively rigid and extend generally upwardly from the upper edge 37, 38 of the front and back panels 32, 33.

As is best shown in FIGS. 1 and 2, the bag topper 10 preferably comprises a top panel 11 and two side fastening portions or means 12, wherein the portions 12 may be generally perpendicular to the top panel 11. The fastening portions 12 each provide a clip portion 13 for attaching the bag topper 10 to a bag 30. When the bag topper 10 is moved in a downward direction (represented by arrow A), the fastening portions 12 are inserted into the opening 41 of the bag and the clip portions 13 are positioned on the outside of the creases 36 of the bag. In other words, the clip portion 13 is a cut-out portion, such that the cut-out portion is positioned on one side of the crease 36 and the opening from the cut-out portion is on the other side of the crease 36. In this way, the bag topper 10 is fastened to or supported on the upper edges 39 of the side walls 34. However, the bag topper 10 may instead be rotated 90 degrees so that the bag topper is fastened to or supported on the upper edges 37, 38 of the front and back panels 32, 33, respectively.

While this embodiment illustrates one portion of fastening portion 12 inside the bag and one portion outside the bag 30, the fastening portion 12 may instead only be either inside or outside of the bag 30. Further, the bag topper 10, or any of the alternative embodiments thereof, may also be used with a bag that does not have creases or folds in its side panels. In this case, the fastening means does not rely on the use of a crease or fold for placement of the bag topper relative to the opening in the bag. Thus, the fastening portion 12 may alternatively include clasps, clips, hooks, hook and loop, pins, snaps, repositionable adhesive fasteners, and the like. FIG. 3 shows the bag topper 10 of the present invention as fastened onto the top edges of the side walls 34 of bag 30, in accordance with the present invention, where the bag topper 10 at least partially covers the opening 41. The top panel 11 may be configured so that it covers most, some, or all of the opening 41, depending on the desired appearance and function of the bag topper.

Figure 4:
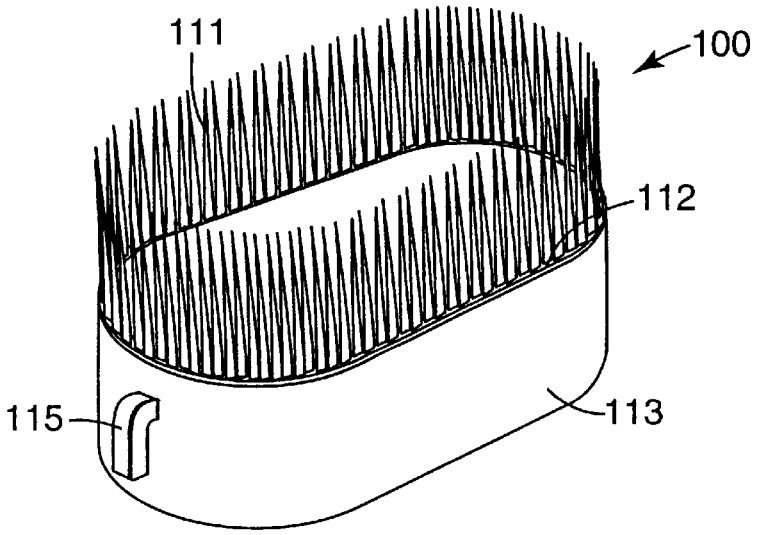
FIG. 4 is an isometric view of an alternative embodiment of the closing mechanism of the present invention.
Figure 5:
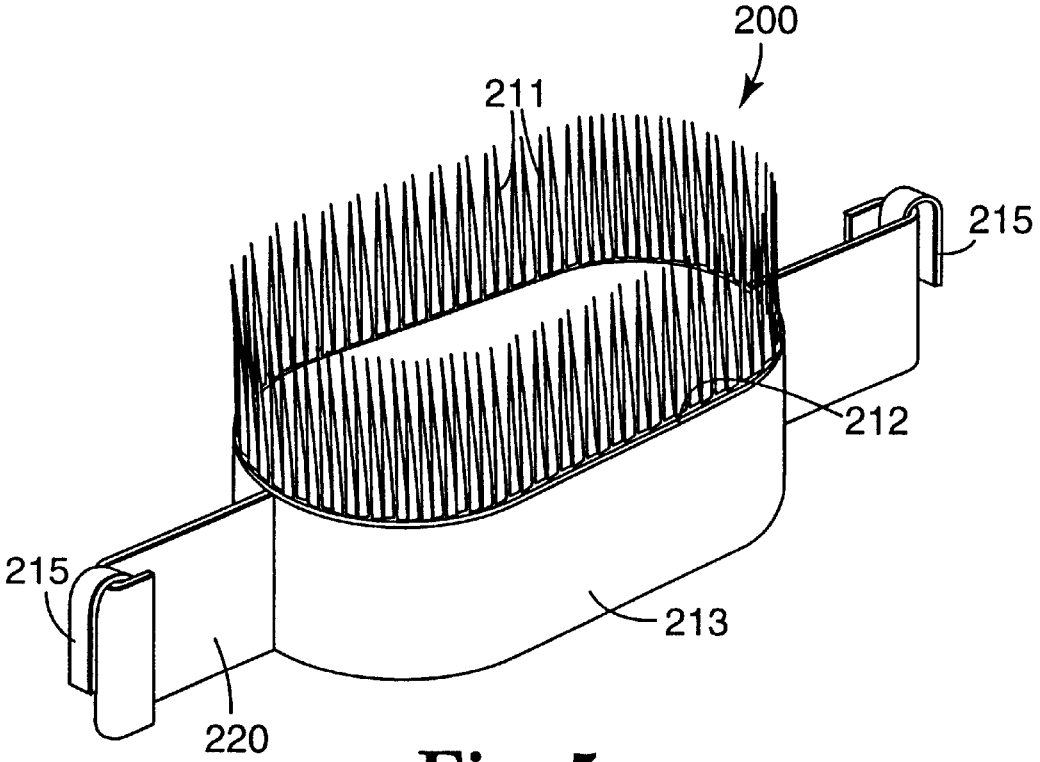
FIG. 5 is an isometric view of an alternative embodiment of the closing mechanism of the present invention having decorative fringe or ribbon along the upper edge of the closing mechanism.
Figure 6:
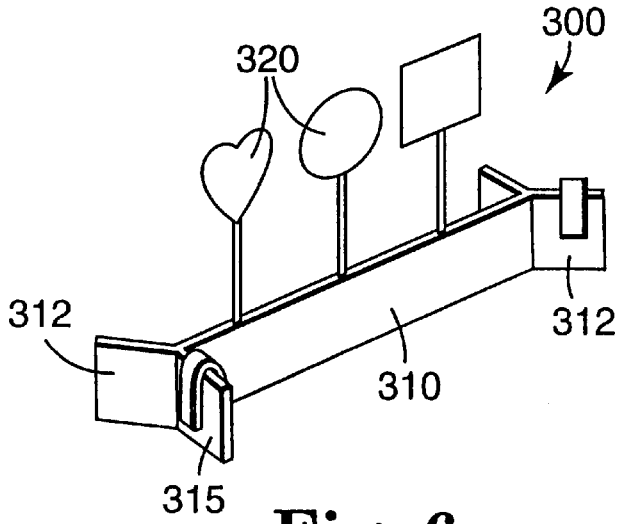
FIG. 6 is an isometric view of an alternative embodiment of the closing mechanism of the present invention showing decorative figures and cut-out objects projecting from the top of the closing mechanism.

Additional embodiments of the present invention are illustrated in FIGS. 4 through 6. While these represent various configurations, these illustrations are not meant to limit the various configurations of the bag topper of the present invention. Furthermore, any of the configurations could have additional elements and such additional elements may be used on the various configurations illustrated herein. For example, the bag topper, particularly the fastening portions 12, could be configured with an adhering means that facilitates adherence to the inside or outside surface of a gift bag. This adhering means could be in the form of a patterned adhesive layer, a strip of adhesive, such as transfer adhesive, hook and loop fasteners, and the like. The adhering means can provide for permanent or repositionable adhesion to the gift bag. In addition, any of the bag toppers of the invention may have decorative elements attached thereto, which may include any of a number of visually appealing two or three-dimensional elements, such as fringes, ribbons, balloons, or the like.

Referring now to FIG. 4, an alternative embodiment of a bag topper 100 is illustrated. In this embodiment, the bag topper 100 has an attached decorative element, such as a decorative fringe or ribbon 111 extending from an upper edge 112 of a positioning collar 113. As shown, the bag topper 100 is generally oval in shape, although this is not a limitation to the configuration of the shape of the bag top 100. The bag top 100 further includes an attaching means 115 that may attach to the creases 36 and the bag 30, in a similar manner to that shown in FIGS. 2 and 3. In this particular embodiment, the attaching means 115 comprises a hook-like portion that can rest over the upper edges 39 of side panels 34. However, the attaching means 115 may instead include clasps, clips, hooks, hook and loop, pins, snaps, repositionable adhesive fasteners and the like. Thus, the attaching means 115 of the bag top 100 may or may not be inside the cavity of the bag 30, although the collar 113 will be at least partially inside the bag 30. The attaching means 115 may also be a cut-out portion, such that the cut-out portion is positioned on one side of the crease while the opening from the cut-out portion is on the other side of the crease.

Figure 4A:
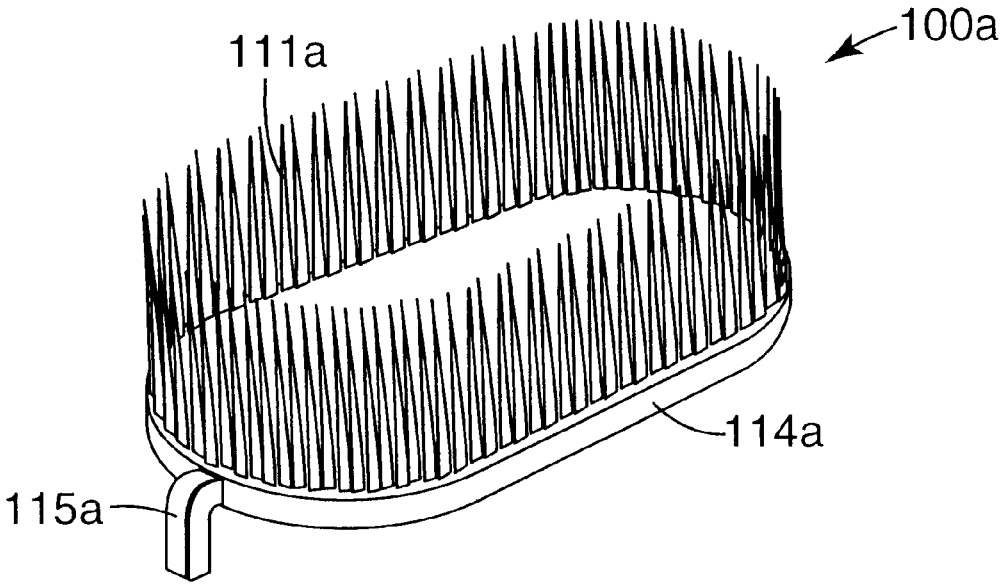
FIG. 4*a* is an isometric view of an alternative embodiment of the closing mechanism of the present invention.

FIG. 4*a* shows an alternative embodiment of a bag topper 100*a* that is similar to the embodiment of FIG. 4 in that it also includes a hook-like portion 115*a* that can rest over the upper edges of the side panels of a bag. In this embodiment, bag topper 100*a* includes a body portion 114*a* and at least one hook-like portion 115*a* extending from the body portion 114*a* for attaching to a bag 30 in a similar manner to that shown in FIGS. 2 and 3. As shown, bag topper 110*a* further optionally includes a decorative fringe or ribbon 111*a*.

Another alternative embodiment of the bag topper of the present invention is illustrated in FIG. 5 as bag topper 200. The bag topper 200 is similar to that of bag topper 100 except that attaching means 215 are attached to a collar 213 by way of at least two extension portions 220. As with FIG. 4, bag topper 200 may have attached decorations, such as a decorative fringe or ribbon 211 extending beyond the upper edge 212 of the collar 213.

An additional alternative embodiment of the bag topper of the present invention is illustrated in FIG. 6, as bag topper 300. In this embodiment, bag topper 300 is provided with a center portion 310 from which extend two V-shaped portions 312 at opposite ends of the center portion 310 that have attaching means 315 attached thereto. The V-shaped portion 312 may advantageously be formed to correspond with the creases 36 in a bag 30 created when the side panels 34 are folded along the longitudinal crease or fold 36. The bag topper 300 further is provided with decorative figures 320, shown in the Figure as cut-out objects projecting from the top of the center portion 310 of the bag topper 300. To use the bag topper 300, the bag topper is preferably positioned above the opening of a bag and inserted into the opening of the bag until the attaching means 315 hook over the edge of the side panels of the bag. However, the attaching means 315 is only one of many attaching devices that are considered to be within the scope of the invention. Again, the attaching means 315 could be clasps, hooks, clips, hook and loop, snaps, or repositionable adhesive fasteners. The attaching means 315 may also be a cut-out portion, such that the cut-out portion is positioned along one side of the crease and the opening from the cut-out portion is on the opposite side of the crease.

In accordance with the present invention, it is desirable that the material used to construct the bag topper is sufficiently rigid so that the topper retains its shape when supported on the top edges of the bag. However, it is also desirable that the bag topper be relatively lightweight so that it does not cause the sides of the bags to collapse when the topper is placed on the top edges of the bag.

While the bag topper of the present invention preferably includes two fastening means, where one fastening means engages with the upper edge of one wall and the other fastening means engages with the upper edge of an opposite wall, the bag topper may include more or less than two fastening means. For example, if the bag topper has more than two fastening means, the fastening means may also attach to the upper edge of walls that are adjacent to the opposite walls (e.g., one fastening means on each of the two side walls and one fastening means on a front wall), or there may be multiple fastening for each wall to which the topper is to be secured.

The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein but only by the structures described by the language of the claims and the equivalence of those structures.

What is claimed is:

1. A gift package comprising:

a bag comprising generally parallel front and rear walls, each having a top edge, a bottom edge opposite the top edge, and two lateral edges, a pair of generally parallel side walls, each having a top edge, a bottom edge opposite the top edge, two lateral edges, and a generally longitudinal fold having a first end adjacent to the top edge of the side wall and a second end spaced from the first end, wherein the lateral edges of the front and rear walls are joined to the lateral edges of the side panels, and a bottom panel having two pairs of generally parallel lateral edges, wherein the lateral edges of the bottom panel are joined to the bottom edges of the front, rear, and side walls to form a container having an opening defined by the top edges of the front, rear, and side walls; and a bag topper comprising a body portion having a top surface, a bottom surface, a front edge, a back edge, side edges extending between the front and back edges, and at least one clip projecting from at least one side edge of the body portion for fastening the bag topper to at least one of the top edges of the side walls wherein the at least one clip engages with the top edge of at least one of the side walls of the bag to support the bag topper on the top edge of the wall.

2. The gift package of claim 1, wherein each of the pair of side walls further comprises at least two diagonal folds, each extending from the bottom edge of the side wall toward the second end of the longitudinal fold.

3. The gift package of claim 2, comprising at least two clips, wherein one clip fastens to the longitudinal fold in one of the side walls and another clip fastens to the longitudinal fold in the other of the side walls.

4. The gift package of claim 1, wherein the bag topper further comprises at least one decorative element extending therefrom.

5. The gift package of claim 1, wherein the bag topper is made of material that is least as rigid as the bag material.

6. A gift package comprising:

a bag comprising generally parallel front and rear walls, each having a top edge, a bottom edge opposite the top edge, and two lateral edges, a pair of generally parallel side walls, each having a top edge, a bottom edge opposite the top edge, two lateral edges, and a generally longitudinal fold having a first end adjacent to the top edge of the side wall and a second end spaced from the first end, wherein the lateral edges of the front and rear walls are joined to the lateral edges of the side panels, and a bottom panel having two pairs of generally parallel lateral edges, wherein the lateral edges of the bottom panel are joined to the bottom edges of the front, rear, and side walls to form a container having an opening defined by the top edges of the front, rear, and side walls; and a bag topper comprising a body portion having a top surface, a bottom surface, a front edge, a back edge, side edges extending between the front and back edges, and at least one hook portion projecting from at least one side edge of the body portion for removably fastening the bag topper to at least one of the top edges of the side walls, wherein the at least one hook portion engages with the top edge of at least one of the side walls of the bag to support the bag topper on the top edge of the wall.

* * * * *